US005501402A

United States Patent [19]

Jones

[11] Patent Number: 5,501,402

[45] Date of Patent: Mar. 26, 1996

[54] PATCHING PAN DEVICE

[76] Inventor: Daniel K. Jones, 5337 Reiner Rd., Madison, Wis. 53704

[21] Appl. No.: 164,367

[22] Filed: Dec. 9, 1993

[51] Int. Cl.[6] ..... A01C 15/00

[52] U.S. Cl. ..... 239/650; 193/16; 193/34; 222/610; 239/657; 239/689

[58] Field of Search ..... 239/657, 664, 239/661, 668, 650, 689; 193/5, 23, 2 R, 16, 17, 22, 33, 34; 222/609, 610

[56] References Cited

U.S. PATENT DOCUMENTS

| | | | |
|---|---|---|---|
| 134,293 | 12/1872 | Kneisly | 239/650 |
| 882,605 | 3/1908 | Young | 193/17 |
| 956,078 | 4/1910 | Greenfield | 193/5 |
| 1,563,202 | 11/1925 | Lentz . | |
| 2,253,248 | 8/1941 | Palmer . | |
| 2,350,476 | 6/1944 | Richey | 239/650 |
| 2,652,288 | 9/1953 | Sands | 193/16 X |
| 2,997,213 | 8/1961 | Richards . | |
| 3,552,346 | 1/1971 | Garden . | |
| 3,693,774 | 9/1972 | Meitl | 193/17 |
| 4,122,932 | 10/1978 | Neubert et al. | 193/5 |
| 4,250,986 | 2/1981 | Buehler | 193/5 |
| 4,881,782 | 11/1989 | Gagner | 193/5 |
| 4,886,214 | 12/1989 | Musso, Jr. et al. | 239/657 |

FOREIGN PATENT DOCUMENTS

| | | | |
|---|---|---|---|
| 3536388 | 4/1987 | Germany | 239/689 |

*Primary Examiner*—Andres Kashnikow
*Attorney, Agent, or Firm*—DeWitt Ross & Stevens

[57] ABSTRACT

The patching pan is a device for use with a truck having a material containment bed with a material distribution opening. The patching pan is rotatably and detachably mounted to the truck. In a first position, patching material is urged through the distribution opening onto the patching pan from which the material may be easily removed. In a second position, the patching pan is located below the material containment bed out-of-the-way such that the truck may move freely from one location to another.

13 Claims, 3 Drawing Sheets

PATCHING PAN DEVICE

BACKGROUND OF THE INVENTION

1. Field of the Invention

The present invention relates to a truck material discharge apparatus. More particularly, the present invention is directed to a dump truck attachment for use in road repair.

2. Description of the Prior Art

A variety of factors require periodic roadway surface maintenance. It is necessary to repair road surfaces when holes, cracks or other surface deteriorations appear due to heavy traffic conditions or weather erosion. Each hole in a roadway surface must be filled with roadway repair material so that the hole is plugged and flush with the rest of the roadway surface.

It has been the practice in the prior art to hand shovel a quantity of road repair material from the body of a truck. Considerable manual labor is required in order to repair the roads. As a result, methods of road repair, which reduce the amount of manual labor and facilitate the road repair operation are in demand.

One example of these methods is found in U.S. Pat. No. 1,563,202 to Lentz, which is directed to a road patch material spreader for use on a dump truck. The material spreader is a flat, substantially horizontal shelf that attaches to the back of a dump truck body and extends the width of the body. The shelf is located behind the truck body to receive road repair material from the dump box of a truck. The dump box may be raised to allow gravity to roll the repair material back toward the pan. An agitator shaft expels the repair material.

U.S. Pat. No. 2,253,248 to Palmer is directed to a spreader box attached to the rear of a dump truck to receive repair material from a dump box. The device facilitates the spreading of repair material over a road bed directly from the dump box without the aid of manual labor or from the top of the box by a shovel held by a laborer.

U.S. Pat. No. 2,997,213 to Richards et al. discloses a material discharge control attachment for dispensing a repair mixture on the roadway surface from a dump truck. The attachment is located at the rear of the dump truck and extends the entire width of the dump truck and also to the ground level. It has a number of chutes with doors, which are lifted to allow the material to drop onto the roadway surface.

U.S. Pat. No. 3,552,346 to Garden discloses a sand-bagging device which attaches to the rear end of a dump truck for filling up bags with sand or soil from the truck body. The device is related since it attaches to the rear of a truck body and is situated to receive material from the dump box.

The prior art devices have some disadvantages. First, they are difficult to attach to the truck body as they generally require many attachment points along the rear end of the truck. Further, the devices cannot be readily removed or replaced on the truck body.

Another disadvantage is the large size of the prior art devices. Each of the described devices extends the width of the rear of a dump truck body. When they are attached, they are virtually immovable. There may be times when a truck operator will use the truck containment box for purposes other than road repair. In those instances it can be difficult to use the truck since the prior art devices would be in the way of or prevent any other type of use. Further, the cumbersome devices of the prior art impede free movement of the vehicle since it is difficult to drive a truck at normal road speeds with such an attachment.

SUMMARY

The above-mentioned disadvantages are overcome by the present invention which is directed to a patching pan device for use with a vehicle having a material containment bed with a material distribution opening and a spinner attachment shaft. The patching pan includes a material distribution pan adapted to be detachable along with a means rotatably mounting the pan to the vehicle and positioning the pan to receive material from a distribution opening. In a first operating position, the patching pan is located below the distribution opening and a second stored position locates the pan away from the opening. The device further includes a collar for rotatably mounting the pan to a shaft attached to the vehicle. The device may be used with a vehicle such as a truck having a dump body or a V-box.

The patching pan of the present invention is configured to connect to a truck "spinner shaft." The spinner shaft is a permanently mounted, generally vertically disposed shaft used to connect a sand or salt spreader, also known as a "spinner," during the winter. When the spinner is removed, the patching pan is readily interchangeable and attaches directly to the spinner attachment shaft.

An advantage of the present invention is that it is an efficient use of municipal resources. The patching pan provides a means by which trucks configured for winter salt-spreading or sand-spreading may be employed during the summer months for road repair. Further, the patching pan is made to have variable positions such that in a first operating position it is located to receive road repair material from a discharge passage. It may be moved to a second storage position such that it is away from the discharge passage under the truck or into another position not interfering with other operations of the truck. Further, the attachment may be easily attached or detached from the truck to allow the truck to be used for other purposes. The device does not require customization of the truck body.

Reference is now made in detail to the preferred embodiments of the invention, examples of which are illustrated in the accompanying drawings.

DETAILED DESCRIPTION OF THE PREFERRED EMBODIMENT

Figure 1:
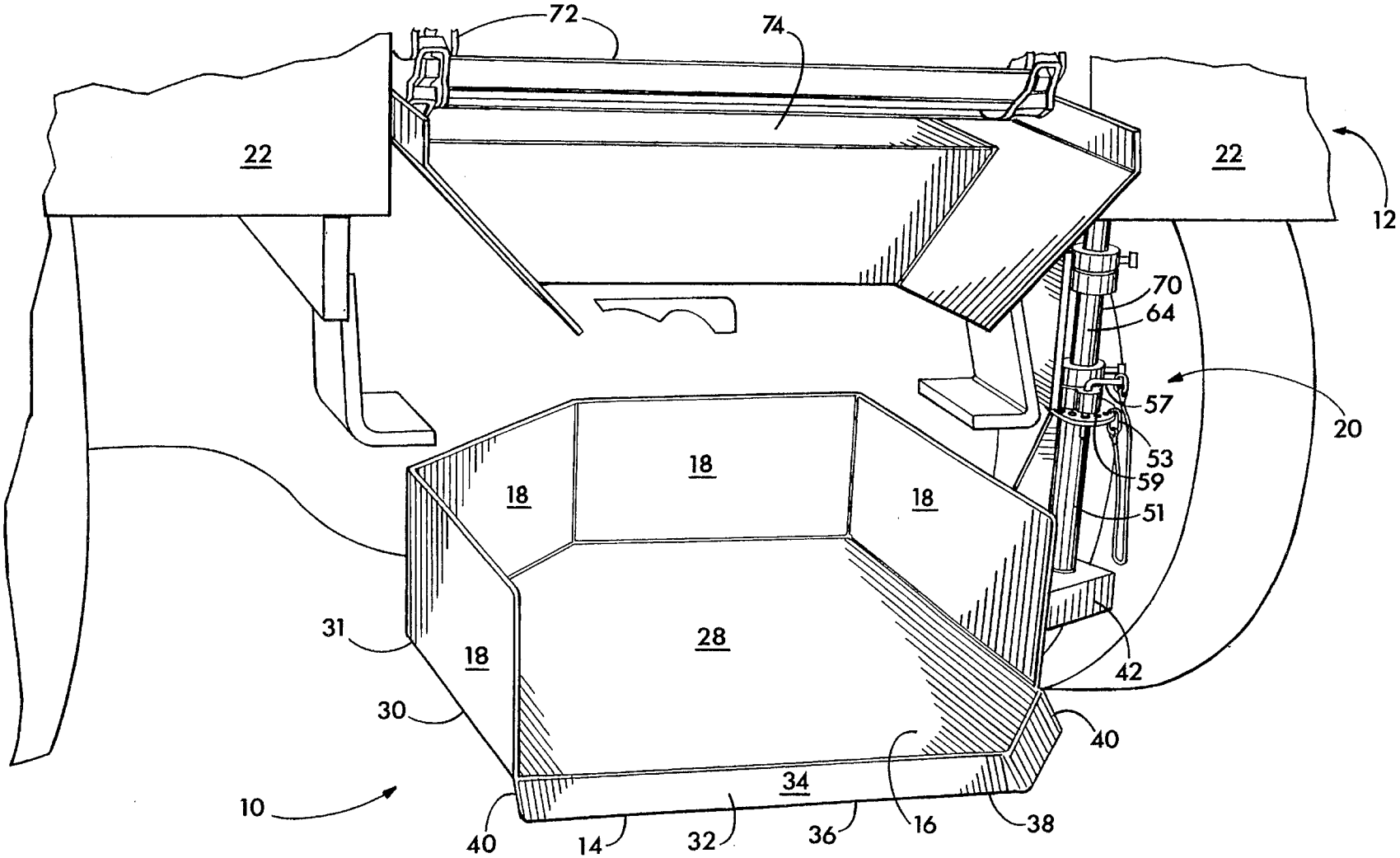
FIG. 1 is a perspective view of a patching pan attached to the rear of a truck.

Reference is now made to the figures. In the figures, similar components will have the same reference numerals throughout the several drawings. The present invention illustrated in FIG. 1 is a patching pan device 10 that may be used with a truck 12, known to the art, to receive patching material such as asphalt or the like and temporarily contain it for easy access by a worker. The truck may be any type of vehicle that is configured to contain material such as asphalt.

In the preferred embodiment the truck 12 includes a dump box or a V-box, both of which are referred to by reference number 22. A dump box is a rectangular material holding bin that tilts up from a front end of a truck with a downward slope toward the rear of the truck or from one side of a truck to the other side. A V-box is a rectangular material holding bin that has side walls sloping in a V-shape with the open end up. Either type of box 22 may be fitted with a conveyor mechanism to move material from one end to another or from side to side.

The patching pan device 10 includes a receiving platform 14 from which the material is removed to repair roads or other driving surfaces, in the preferred embodiment. However, it may be used for gravel conveyance or landscaping work as well. The receiving platform 14 includes a substantially horizontal base sheet 16 with a substantially vertical wall 18 bordering most of the perimeter. Attached to the platform 14 is a connection means 20 for connecting the platform 14 to the truck 12 at the rear of truck box 22. The base sheet 16 includes an upper surface 28 into which road repair material is urged from the truck box 22, a lower second surface 30 and an edge 31. The base sheet 16 may also be provided with a rearward slope to engage the use of gravity in discharging road repair material. As illustrated in the figures, the receiving platform 14 is configured with six sides in the preferred embodiment to optimize material removal and platform 14 storage. The six-sided configuration is specific to a particular style of truck. Any configuration may be integrated depending upon the type of truck utilized.

A lip 32, integral with the sheet 16, depends at a downward angle from the sheet 16 in order to facilitate easy removal of repair material. The lip 32 includes a first side 34, a second side 36, a lower edge 38 and two side ends 40. Since repair material may be removed from the platform 14 by shoveling or scooping, the lip edge 38 provides a directional aid to the shovel when the shovel may be aimed slightly too low; in such an instance, the shovel will be nudged upward onto the upper surface 28 of the base sheet 16. The lip 32 further functions as an exit ramp for the repair material if the material is urged from the base sheet 16 directly to the ground.

Integral with the sheet edge 31 and depending in an upward direction from the base sheet 16 is the vertical wall 18. The vertical wall 18 provides a barrier for containing repair material. In the preferred embodiment, the wall 18 is disposed at the sheet edge 31 on four edges of the six-edged sheet 16. A portion of the sheet 16 remains open or unwalled to provide an opening or exit for the repair material and an entrance for the shovel. As repair material drops onto the sheet 16 from the truck 12, the wall 18 contains the material preventing it from falling in the wrong direction. Further, the wall 18 provides a backstop, forcing repair material onto a scoop or shovel when a shovel edge is pushed through the material adjacent to the wall 18.

Figure 2:
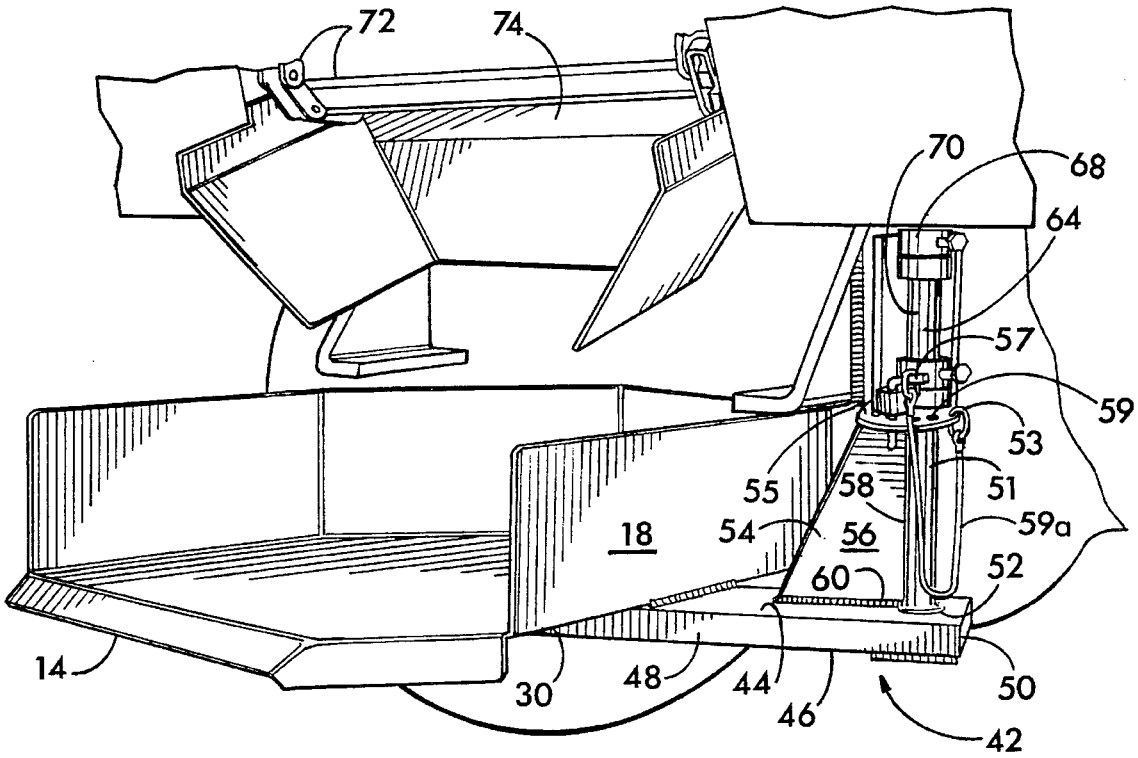
FIG. 2 is a perspective view of the patching pan illustrated in FIG. 1 from a right side perspective.
Figure 4:
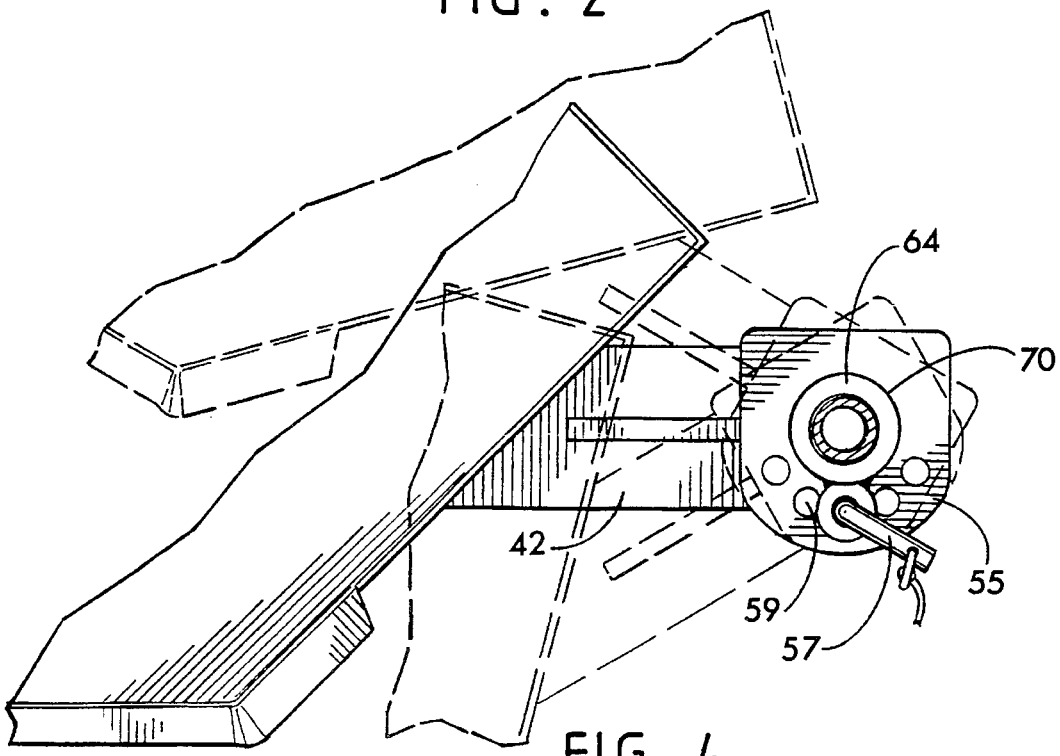
FIG. 4 is a top partial cross-sectional view of the patching pan taken along lines 4—4 of FIG. 1.
Figure 3:
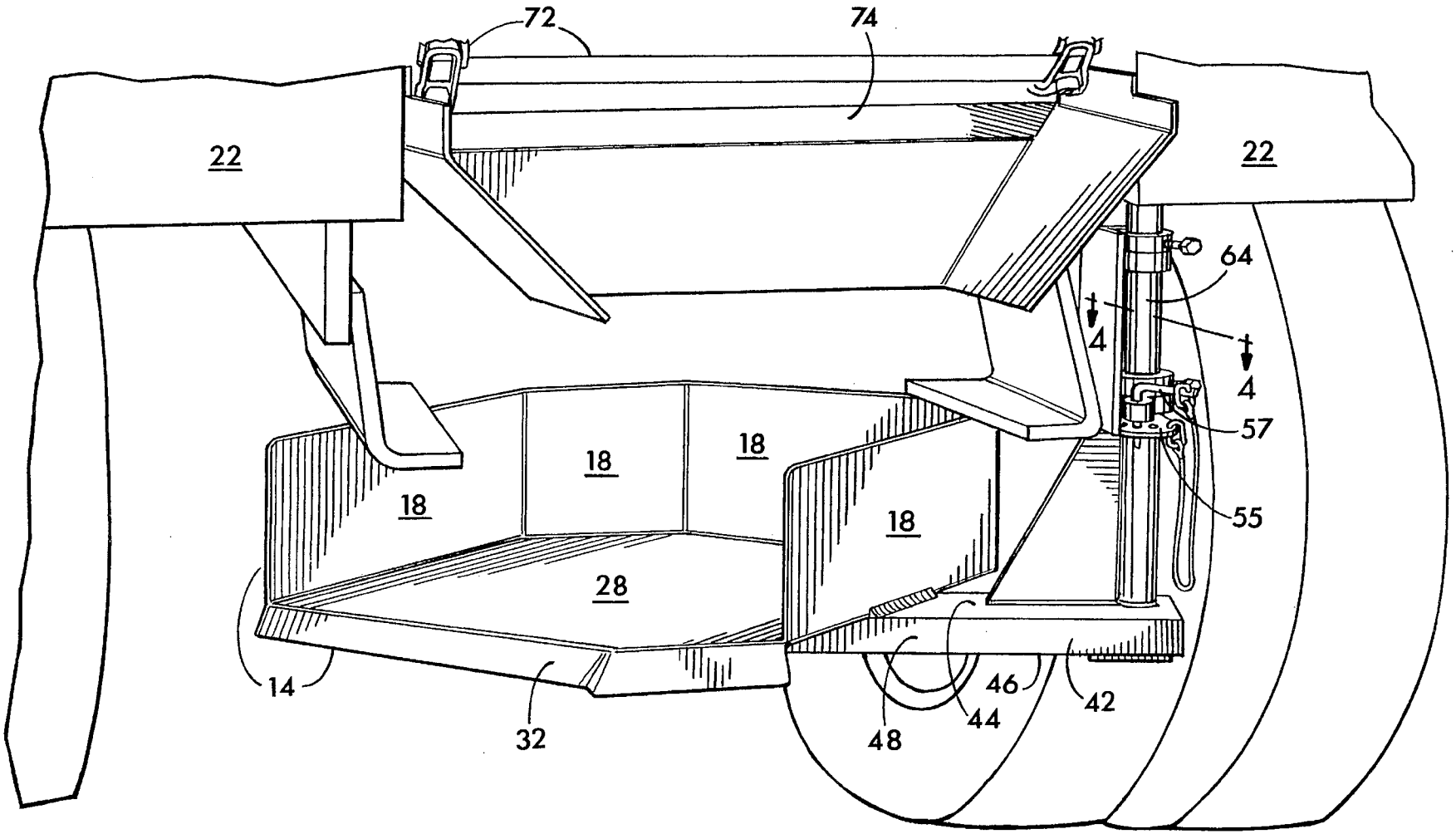
FIG. 3 is a perspective view of the patching pan from the vantage point shown in FIG. 1 illustrating it in a second pivot position under the truck bed.

Attached to the second surface 30 of the sheet 16 is an arm 42 illustrated in FIGS. 2, 3 and 4. The arm 42 has a substantially horizontal upper first side 44, a lower second side 46, side edges 48 and an end 50. The arm 42 extends from under the second surface 30 of the receiving platform 14 at an angle toward the rear of the truck 12. The arm may be attached to the second surface 30 by welding or other conventional means known to the art.

Joined to the first side 44 of the arm 42 is a substantially vertical cylindrical collar 51, which is substantially perpendicular to the first side 44 of the arm 42. The collar 51 is hollow and cylindrical, and provides a passage for attachment to the truck 12. The collar 51 has a first end 52 attached to the arm first side 44 and a second open end 53 as shown in FIG. 2.

A locking means including a plate 55 is attached to the collar second end 53. The plate 55 provides a rotational locking mechanism for the platform 14. Apertures 59 within the perimeter of the plate 55 allow a stationary pin 57 to be positioned therethrough preventing the plate 55 from pivoting and thereby preventing collar 51 and platform 14 rotation. The pin 57 may be attached to plate 55 by a retaining rope **59*a* to prevent loss of the pin 57**.

An angled shoulder 54 is joined to the collar 51 along its length providing support to maintain the collar in a substantially vertical position. Triangular shaped, the shoulder 54 has opposing sides 56, a first edge 58, a second edge 60 and a third edge 62. The shoulder first edge 58 joins with the collar 51 and the shoulder second edge 60 joins with the arm first side 44. The shoulder 54 is welded to the collar 51 and the arm first side 44 in the preferred embodiment.

The patching pan device 10 is releasibly connected to the truck 12 in the following manner. The truck 12 is typically provided with a downwardly depending cylindrical "spinner" shaft 64 primarily for receiving a sand or salt "spinner" depenser known to the art. The shaft 64 has a first end, not shown, a second end 68 and an outer surface 70. The second end 68 is attached to the truck 12. By slipping the collar 51 over the shaft 64 until the shaft 64 protrudes below the collar 51, the shaft 64 may be secured preventing the collar 51 from slipping off. Connection is accomplished by attaching the collar 51 to the shaft 64 according to many attachment means known to the art including a cotter pin inserted through the shaft first end, or by providing for a threaded shaft first end onto which a fastener may be torqued. The shaft outer surface 70 provides a bearing-like mechanism when inserted within the collar 51 to allow pivoting of the collar 51 and thereby the entire platform 14.

Pivoting the collar 51 is necessary to allow the platform 14 to be positioned at various locations. The platform 14 may be pivoted out of the way into a position directly below the rear of the truck 12 when the truck 12 is moving from one working location to another as illustrated in FIG. 3. When the truck 12 reaches its job site, the platform 14 may be pivoted out from below the truck into a working position to the rear of the truck 12 below the material opening as illustrated in FIGS. 1 and 2. Further, the platform 14 may be positioned at variable locations between the fully operational position and the storage position as shown with phantom lines in FIG. 4.

In operation, road repair material, which is asphalt in the preferred embodiment, is contained in the truck box 22. The truck box 22 may be configured with a conveyor 72 disposed on the box 22 floor between the box 22 sides. The conveyor 72 may be turned on to move material from forward in the box 22 toward a rear opening 74. The asphalt is urged through the rear opening 74 by the conveyor 72 and gravity assisted by an inclined box floor; dropping vertically onto the platform 14 when it is in a working position. With or without a conveyor, a dump box may be inclined to urge the asphalt towards the truck rear opening. Workers behind the truck 12 may push the asphalt over the lip 32 onto the road surface or shovel it out using the wall 18 as a backstop for the asphalt. Controls for the conveyor 72 and truck box 24 may be conveniently located at the rear of the truck 12 to control asphalt flow. After the job is completed the stationary pin 57 can be disengaged to pivot the platform 14 under the truck 12 where the pin 57 is then replaced to lock the platform in a storage position.

The foregoing is considered as illustrative only of the principles of the invention. Further, since numerous modifications and changes will readily occur to those skilled in the art, it is not desired to limit the invention to the exact construction and operation shown and described. Therefore, all suitable modifications and equivalents fall within the scope of the invention.

I claim:

1. A patching pan device comprising:

a. a vehicle having a material containment bed with a material distribution opening;

b. a material distribution pan including a substantially horizontal base sheet with an upper surface adapted to receive and support material thereupon, an opposing lower surface, and an edge therebetween, the edge having a continuous substantially vertical wall arising therefrom about at least a major portion of the edge; and c. a collar joined to the pan, the collar being pivotally and detachably connected to a vertically disposed shaft attached to the vehicle, whereby the pan may be positioned in an operating position wherein the upper surface may receive material from the distribution opening, and a stored position wherein the pan is located generally away from the distribution opening.

2. The device of claim 1 wherein the collar is pivotably and detachably connected to the shaft, the shaft including a first open end and a second attachment end which is attached to the vehicle.

3. The device of claim 1 wherein the mounting means further includes a securing means for affixing the pan to the shaft.

4. The device of claim 3 wherein the collar includes a plate located near the shaft second end having slots to receive a pin to prevent the collar from pivoting.

5. The device of claim 1 wherein the vertical wall defines the opening.

6. The device of claim 1 wherein a lip integral with the platform extends downward on an angle from the opening to facilitate distribution of material.

7. The device of claim 1 wherein the material containment bed consists of a dump body.

8. The device of claim 1 wherein the material containment bed consists of a V-box.

9. The device of claim 1 wherein the means for rotatably and detachably mounting the pan to the vehicle comprises a substantially horizontal arm including a first end attached to the base sheet and a second end joined to a collar which is rotatably and detachably mounted to a vertical shaft attached to the vehicle.

10. The device of claim 9 wherein the vertical shaft is a spinner attachment shaft.

11. A patching pan device comprising:

a. a vehicle including a material containment bed with a material distribution opening, and further including a spinner attachment shaft attached to the vehicle in a substantially vertical orientation; and b. a material distribution pan including a substantially horizontal base sheet with an upper surface adapted to receive and support material thereupon, an opposing lower surface, and an edge therebetween, the edge having a continuous substantially vertical wall arising therefrom about at least a major portion of the edge, and further including a collar attached to the pan, the collar being rotatably and detachably connected to the spinner attachment shaft so that the pan may be rotatably positioned in an operating position wherein the upper surface may receive the material from the distribution opening, and a stored position wherein the upper surface is located away from the distribution opening.

12. A patching pan device comprising:

a. a vehicle having a material containment bed with a material distribution opening;

b. a material distribution pan including a substantially horizontal base sheet with an upper surface adapted to receive and support material thereupon, an opposing lower surface, and an edge therebetween, the edge having a continuous substantially vertical wall arising therefrom about at least a major portion of the edge; and c. a substantially horizontal arm including a first end attached to the base sheet and a second end joined to a collar which is rotatably and detachably mounted to a vertical shaft attached to the vehicle, whereby the pan may be positioned in an operating position wherein the upper surface may receive material from the distribution opening, and a stored position wherein the pan is located generally away from the distribution opening.

13. The device of claim 12 wherein the vertical shaft is a spinner attachment shaft.

* * * * *